US006260604B1

(12) United States Patent
Lippold et al.

(10) Patent No.: US 6,260,604 B1
(45) Date of Patent: Jul. 17, 2001

(54) STRAND PULLING-OFF METHOD

(75) Inventors: Carsten Lippold, Rodgau; Karl Hoen, Netphen; Jürgen Bernhardt, Düsseldorf; Lothar Parschat, Ratingen, all of (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/345,589

(22) Filed: Jun. 30, 1999

(30) Foreign Application Priority Data

Jul. 2, 1998 (DE) ..... 198 29 605

(51) Int. Cl.[7] ..... B22D 11/06

(52) U.S. Cl. ..... 164/454; 164/484

(58) Field of Search ..... 164/454, 484, 164/413

(56) References Cited

U.S. PATENT DOCUMENTS 6,044,895 * 4/2000 Kuttner et al. ..... 164/155.4

* cited by examiner

*Primary Examiner*—Harold Pyon
*Assistant Examiner*—Joseph S Del Sole
(74) *Attorney, Agent, or Firm*—Friedrich Kueffner

(57) ABSTRACT

A strand pulling-off method for a metal strand, particularly a steel strip, cast in a curved continuous casting plant, wherein the metal strand is initially vertically pulled from a casting mold, wherein a curved shape is then imparted on the metal strand in a curved entry driver driven with an entry torque, and wherein, after reaching a horizontal strand travel direction, the metal strand is finally straightened in a curved exit driver driven with an exit torque. An entry speed is assigned to the curved entry driver and an exit speed is assigned to the curved exit driver, the entry torque and the exit torque are determined, and the exit speed is adjusted in such a way that the entry torque as well as the exit torque have a positive value.

4 Claims, 2 Drawing Sheets

STRAND PULLING-OFF METHOD

BACKGROUND OF THE INVENTION

1. Field of the Invention

The present invention relates to a strand pulling-off method for a metal strand, particularly a steel strip, cast in a curved continuous casting plant, wherein the metal strand is initially vertically pulled from a casting mold, wherein a curved shape is then imparted on the metal strand in a curved entry driver driven with an entry torque, and wherein, after reaching a horizontal strand travel direction, the metal strand is finally straightened in a curved exit driver driven with an exit torque.

2. Description of the Related Art

Strand pulling-off methods of the above-described type are generally known in the art. In these methods, the cast metal strand is bent by means of a driven curved entry driver, also called bending driver, from the vertical into a curved shape. After reaching the horizontal, the metal strand is then once again straightened by means of a driven curved exit driver, also called straightening driver, so that the metal strand leaves the curved continuous casting plant in a horizontal strand travel direction.

In the optimum situation, the strand substantially has the shape of a circular arc between the curved entry driver and the curved exit driver. However, even slight differences in the speeds between the drivers have the result that the metal strand is deflected from its ideal line. The metal strand then either extends in the shape of a chord or the metal strand sags through. Accordingly, the speed differences may lead to difficulties in operating the plant or may even lead to interruptions of the casting operation. In either case, the quality of the cast metal strand is negatively influenced.

The book "StranggieBen von Stahl—Einführung und Grundlagen" [Continuous Casting of Steel—Introduction and Basics] by Hans Schrewe, Verlag Stahleisen mbH, D üsseldorf (Germany) 1987, pages 13 and 46 to 50, discloses a strand pulling-off method for a metal strand, particularly a steel strip, cast in a curved continuous casting plant, wherein the metal strand is initially vertically pulled from a continuous casting mold, a curved shape is then imparted on the metal strand in a curved entry driver, the metal strand is then guided in a multiple-roller drive and the metal strand is straightened in several steps, so that the metal strand leaves the curved continuous casting plant after reaching a horizontal strand travel direction.

SUMMARY OF THE INVENTION

Therefore, it is the primary object of the present invention to provide a strand pulling-off method in which a deviation of the cast metal strand from its ideal line is prevented as much as possible.

In accordance with the present invention, an entry speed is assigned to the curved entry driver and an exit speed is assigned to the curved exit driver, the entry torque and the exit torque are determined, and the exit speed is adjusted in such a way that the entry torque as well as the exit torque have a positive value.

In accordance with a preferred feature, the exit speed is lowered when the quotient of exit torque to entry torque exceeds a desired quotient value, and the exit speed is conversely increased when the quotient of exit torque to entry torque drops below the desired quotient value. This ensures that the metal strand follows the ideal line even better.

In accordance with another preferred feature, the desired quotient value is increased when after lowering the exit speed the sum of exit torque and entry torque increases and the desired quotient value is conversely lowered when after an increase of the exit speed the sum of exit torque and entry torque increases. This feature makes it possible that the curved continuous casting plant automatically adjusts an optimum strand shape. Simultaneously, the plant is operated with minimum energy requirements.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
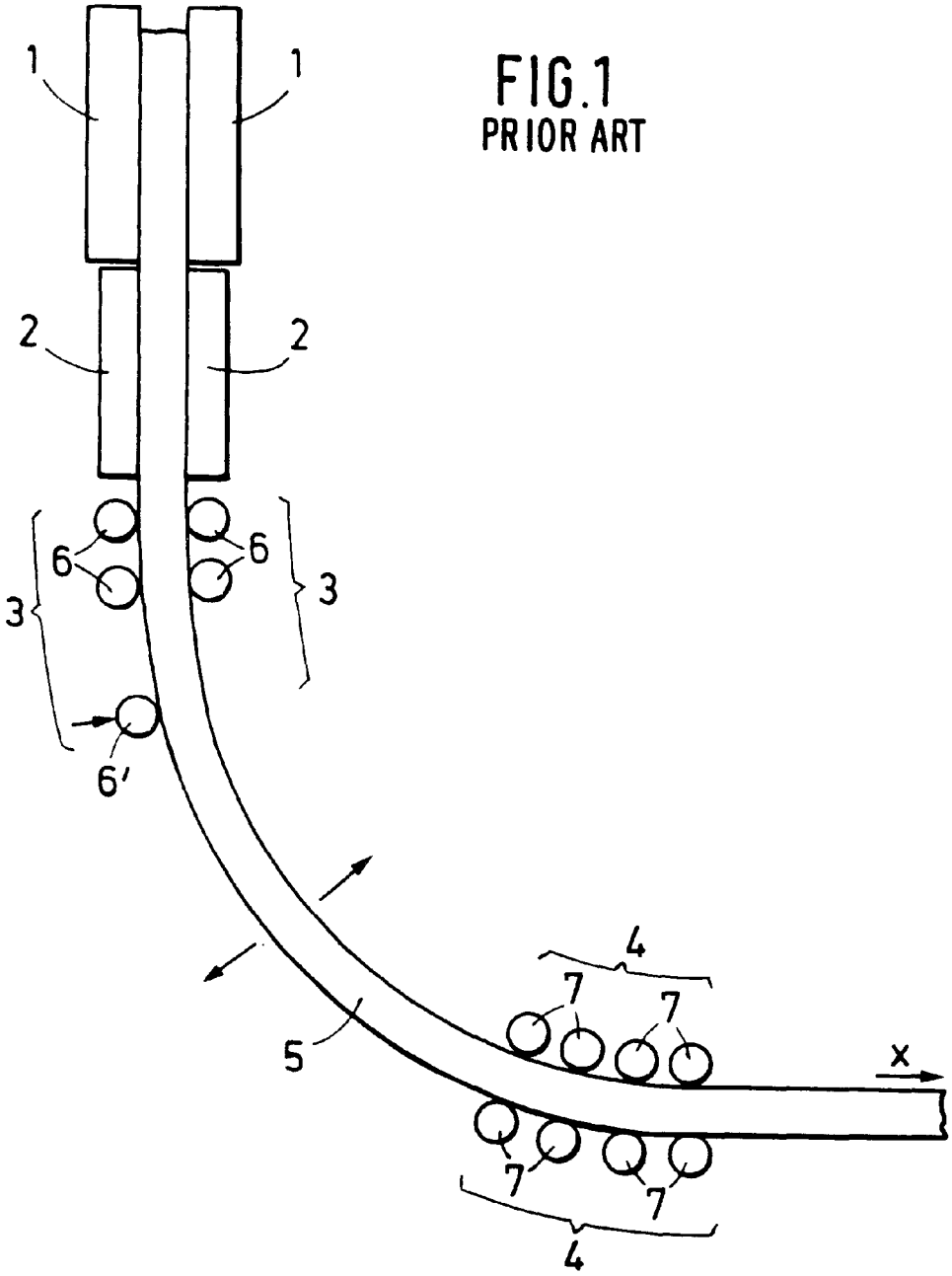
FIG.1 PRIOR ART
FIG. 1 is a block diagram showing a curved continuous casting plant.

As illustrated in FIG. 1, a curved continuous casting plant includes a casting mold 1, a cooling section 2 arranged under the mold 1, a curved entry driver 3 and a curved exit driver 4. In the casting mold 1, liquid metal, for example, steel, is cast into a metal strand 5, for example, a preliminary strip. The metal initially solidifies at the outer sides of the strand and the strand is pulled vertically out of the casting mold 1 with its core still being liquid. After travelling through the cooling section 2, the metal strand 5 is cooled to such an extent that its core also solidifies.

After the complete solidification, the metal strand 5 travels through the curved entry driver 3. The curved entry driver 3 has driven entry rollers 6. The entry rollers 6 are driven with an entry torque $F_e$. The metal strand 5 is pulled with a casting speed $v_G$ out of the casting mold 1 by means of the entry rollers 6. In addition, a curved shape is imparted to the metal strand 5 by means of a bending roller 6', i.e., the metal strand is bent out of the vertical direction.

After travelling through the curved entry driver 3, the metal strand 5 travels freely to the curved exit driver 4. After the metal strand 5 enters and travels through the curved exit driver 4, the metal strand 5 assumes a horizontal strand travel direction x. The curved exit driver 4 has driven exit rollers 7. The exit rollers 7 are driven with an exit torque $F_a$. The metal strand 5 is conveyed further by means of the exit rollers 7. In addition, by means of the exit rollers 6, the metal strand 5 is once again straightened, i.e., the metal strand 5 is bent back from the curved shape into the horizontal direction.

Any type of drive can be used for the curved entry driver 3 and the curved exit driver 4. Usually, electric motors are used. Particularly when using electric motors, the applied torques $F_e$, $F_a$ can be easily determined.

The curved entry driver 3 as well as the curved exit driver 4 are speed-controlled. Accordingly, an entry speed $v_e$ and an exit speed $v_a$ are assigned to the drivers. The entry speed $v_e$ is determined by the casting speed $v_G$. The exit speed $v_a$, on the other hand, is available as a control parameter. Of course, instead of the speeds $v_e$, $v_a$, the rates of rotation of the rollers 6, 7 can also be controlled.

Figure 2:
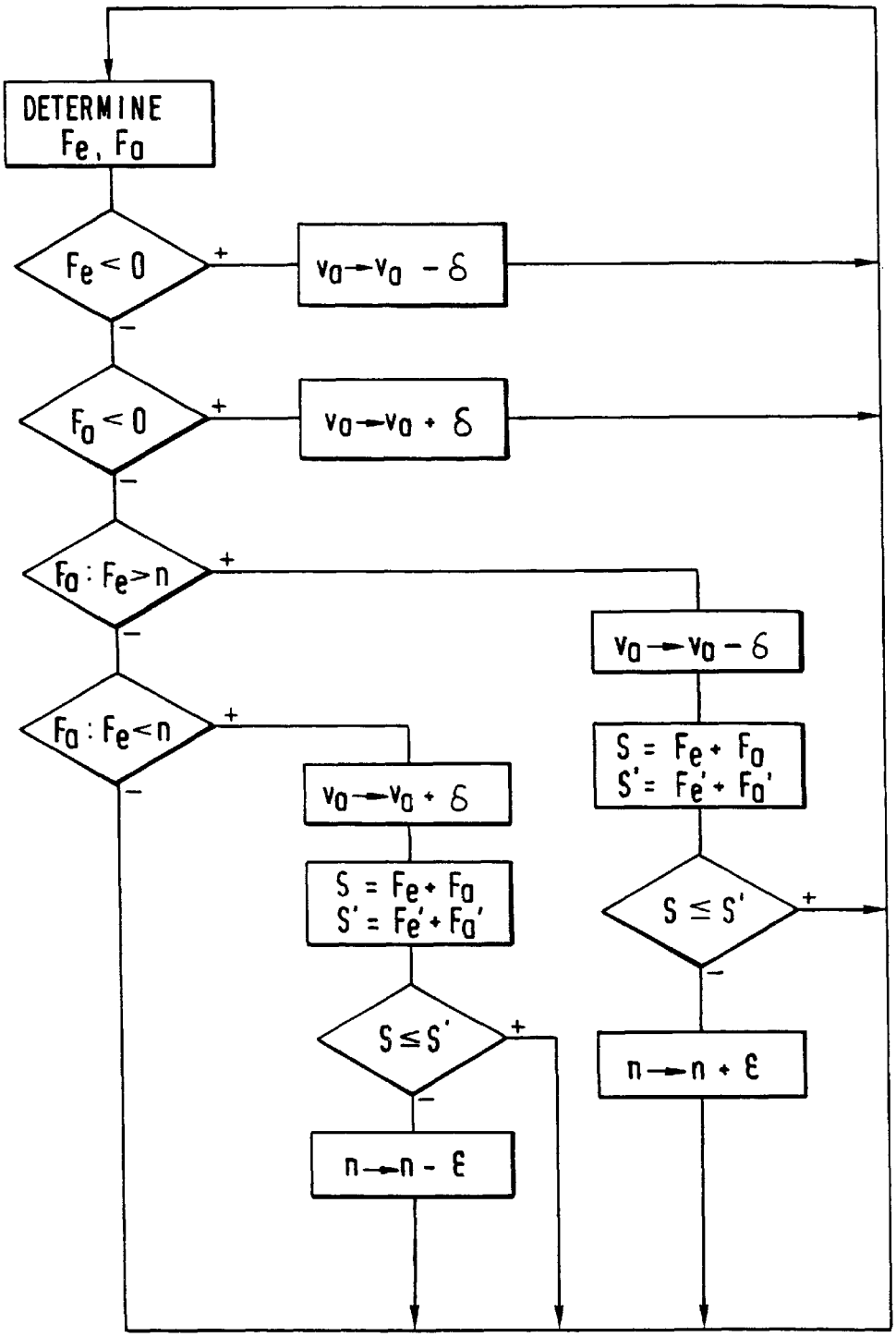
FIG. 2 is a flow chart used for controlling the curved continuous casting plant.

For controlling the exit speed $v_a$, the entry torque $F_e$ and the exit torque $F_a$ are determined as indicated in FIG. 2. When the entry torque $F_e$ has a negative value, the exit speed $v_a$ is lowered because in that case the metal strand 5 is conveyed too quickly by the curved exit driver 4. When the exit torque $F_a$ conversely has a negative value, the exit speed $v_a$ is increased because the metal strand 5 is then conveyed too slowly by the curved exit driver 4. When the entry torque $F_e$ and the exit torque $F_a$ both have a positive value, the conveying power is distributed to both drivers 3 and 4, which is the desired condition. Accordingly, the exit speed $v_a$ is adjusted in such a way that the entry torque $F_e$ as well as the exit torque $F_a$ have a positive value.

In order to ensure a distribution as uniform as possible of the conveying power to both drivers 3 and 4, a desired quotient value n is determined. When the quotient of exit torque $F_a$ to entry torque $F_e$ exceeds the desired quotient value n, the exit speed $v_a$ is lowered. When the quotient of exit torque $F_a$ to entry torque $F_e$ drops below the desired quotient value n, the exit speed $v_a$ is increased. Preferably, the desired quotient value n is greater than one.

As illustrated in FIG. 2, the increase and decrease of the exit speed $v_a$ is an iterative process. In each iteration, the sum S of exit torque $F_a$ and entry torque $F_e$ is formed and compared to the sum S' of the entry torque $F_a'$ and entry torque $F_e'$ of the previous iteration. If the sum S of exit torque $F_a$ and entry torque $F_e$ of the most recent iteration does not exceed the sum S' of the exit torque $F_a'$ and entry torque $F_e'$ of the previous iteration, the desired quotient value n remains unchanged. If, on the other hand, the sum S of exit torque $F_a$ and entry torque $F_e$ of the most recent iteration exceeds the sum S' of the exit torque $F_a'$ and the entry torque $F_e'$ of the previous iteration, this is an indication that the curved continuous casting plant is not yet operated in an optimum manner. In that case, the desired quotient value n is increased if the exit speed $v_a$ has previously been lowered. Conversely, the desired quotient value n is lowered if the exit speed $v_a$ has previously been increased.

The strand pulling-off method according to the present invention makes it possible that an optimum operation of the curved continuous casting plant occurs automatically independently of additional parameters such as, the strand temperature, the strand width and strand thickness, the casting speed $v_G$, the change of the roller diameters due to wear, and the cast metal type and quality. This is of particular importance in thin slab casting plants in which slabs having thicknesses of between 40 mm and 100 mm are cast. This is because in thin slab casting plants the casting speed $v_G$ is significantly higher than in conventional slab plants, so that without a correcting control, critical plant conditions are reached very quickly. Moreover, the strand pulling-off method according to the present invention suppresses or dampens the vibration tendency of the metal strand 5 and prevents the metal strand 5 from slipping through. The geometry of the metal strand 5 is also improved. Finally, the method reduces the tendency of the metal strand 5 to travel in an inclined direction; in addition to other advantages, this results in an improved entry behavior into subsequent units in the curved continuous casting plant.

While specific embodiments of the invention have been shown and described in detail to illustrate the inventive principles, it will be understood that the invention may be embodied otherwise without departing from such principles.

We claim:

1. A strand pulling-off method for a metal strand cast in a curved continuous casting plant, the method comprising initially vertically pulling the metal strand from a casting mold, imparting to the metal strand a curved shape in a curved entry driver driven with an entry torque, finally straightening the metal strand after reaching a horizontal strand travel direction in a curved exit driver driven with an exit torque, assigning an entry speed to the curved entry driver and an exit speed to the curved exit driver, the method further comprising determining the exit torque as well as the entry torque, and adjusting the exit speed such that the entry torque as well as the exit torque each have a positive value.

2. The method according to claim 1, wherein the metal strand is a steel strip.

3. The method according to claim 1, comprising lowering the exit speed when a quotient of the exit torque to the entry torque exceeds a desired quotient value and conversely increasing the exit speed when the quotient of exit torque to entry torque drops below the desired quotient value.

4. The method according to claim 3, comprising increasing the desired quotient value when a sum of the exit torque and the entry torque increases after lowering the exit speed, and conversely lowering the desired quotient value when the sum of the exit torque and the entry torque increases after increasing the exit speed.

* * * * *